US008332290B1

(12) United States Patent
Venturo et al.

(10) Patent No.: US 8,332,290 B1
(45) Date of Patent: Dec. 11, 2012

(54) REAL-TIME REWARDS REDEMPTION

(75) Inventors: Dominic Victor Venturo, Woodbury, MN (US); Robert H. Daly, Minneapolis, MN (US)

(73) Assignee: U.S. Bancorp Licensing, Inc., Minneapolis, MN (US)

( * ) Notice: Subject to any disclaimer, the term of this patent is extended or adjusted under 35 U.S.C. 154(b) by 0 days.

(21) Appl. No.: 13/344,252

(22) Filed: Jan. 5, 2012

(51) Int. Cl.
*G06Q 30/00* (2012.01)

(52) U.S. Cl. ..... 705/33

(58) Field of Classification Search ..... 705/14.33
See application file for complete search history.

(56) References Cited

U.S. PATENT DOCUMENTS

| | | | | |
|---|---|---|---|---|
| 6,138,911 | A * | 10/2000 | Fredregill et al. | 235/383 |
| 6,516,302 | B1 | 2/2003 | Deaton et al. | |
| 6,865,547 | B1 | 3/2005 | Brake et al. | |
| 7,324,962 | B1 | 1/2008 | Valliani et al. | |
| 7,337,949 | B2 | 3/2008 | Roth | |
| 7,624,041 | B2 | 11/2009 | Postrel | |
| 7,676,393 | B2 | 3/2010 | Postrel | |
| 7,680,687 | B2 | 3/2010 | Postrel | |
| 7,689,508 | B2 | 3/2010 | Davis et al. | |
| 7,716,080 | B2 | 5/2010 | Postrel | |
| 7,729,925 | B2 | 6/2010 | Maritzen et al. | |
| 7,856,377 | B2 | 12/2010 | Cohagan et al. | |
| 8,010,405 | B1 | 8/2011 | Bortolin et al. | |
| 8,024,220 | B2 | 9/2011 | Ariff et al. | |
| 8,046,256 | B2 | 10/2011 | Chien et al. | |
| 2007/0088610 | A1 | 4/2007 | Chen | |
| 2008/0103968 | A1 * | 5/2008 | Bies et al. | 705/39 |
| 2008/0133350 | A1 | 6/2008 | White et al. | |
| 2008/0133351 | A1 | 6/2008 | White et al. | |
| 2010/0057553 | A1 | 3/2010 | Ameiss et al. | |
| 2010/0274655 | A1 * | 10/2010 | Postrel | 705/14.27 |

* cited by examiner

*Primary Examiner* — Naresh Vig
(74) *Attorney, Agent, or Firm* — Foley & Lardner LLP

(57) ABSTRACT

A method includes receiving, at a computing system, information regarding a transaction associated with a financial account of a customer. The method also includes determining, based at least in part on the information regarding the transaction, whether to provide a redemption alert to the customer. The method also includes providing the redemption alert to a mobile device of the customer if it is determined that the redemption alert is to be provided. The method further includes receiving a response to the redemption alert from the mobile device of the customer, where the response indicates whether at least a portion of accumulated loyalty rewards of the customer are to be used to pay for at least a portion of the transaction.

20 Claims, 4 Drawing Sheets

REAL-TIME REWARDS REDEMPTION

BACKGROUND

The following description is provided to assist the understanding of the reader. None of the information provided or references cited is admitted to be prior art.

Customer loyalty programs are intended to reward a customer for using a product or service and to incentivize further use of the product or service by the customer. The product or service can be a credit card, a debit card, shopping services provided by a particular merchant or group of merchants, flight services provided by a particular airline or group of airlines, etc. The reward for using the product or service can be in the form of cash back, free gear, discounted gear, free services, discounted services, etc. Traditional customer loyalty programs allow a user to log in to a website to manage and redeem accumulated rewards. Other customer loyalty programs attempt to provide real-time redemption of accumulated rewards. However, such programs require specialized point-of-sale (POS) devices and coordinated cooperation between the entity that is providing the customer loyalty program and the merchant associated with the point-of-sale.

SUMMARY

An illustrative method includes receiving, at a computing system, information regarding a transaction associated with a financial account of a customer. The method also includes determining, based at least in part on the information regarding the transaction, whether to provide a redemption alert to the customer. The method also includes providing the redemption alert to a mobile device of the customer if it is determined that the redemption alert is to be provided. The method further includes receiving a response to the redemption alert from the mobile device of the customer, where the response indicates whether at least a portion of accumulated loyalty rewards of the customer are to be used to pay for at least a portion of the transaction.

An illustrative system includes a receiver configured to receive information regarding a transaction associated with a financial account of a customer. The system also includes a processor operatively coupled to the receiver and configured to determine, based at least in part on the information regarding the transaction, whether to provide a redemption alert to the customer. The system further includes a transmitter operatively coupled to the processor and configured to provide the redemption alert to a mobile device of the customer if it is determined that the redemption alert is to be provided. The receiver is further configured to receive a response to the redemption alert from the mobile device of the customer, where the response indicates whether at least a portion of accumulated loyalty rewards of the customer are to be used to pay for at least a portion of the transaction.

An illustrative non-transitory computer-readable medium has computer-readable instructions stored thereon. The computer-readable instructions include instructions to process received information regarding a transaction associated with a financial account of a customer. The computer-readable instructions also include instructions to determine, based at least in part on the information regarding the transaction, whether to provide a redemption alert to the customer. The computer-readable instructions also include instructions to provide the redemption alert to a mobile device of the customer if it is determined that the redemption alert is to be provided. The computer-readable instructions further include instructions to process a received response to the redemption alert from the mobile device of the customer, where the response indicates whether at least a portion of accumulated loyalty rewards of the customer are to be used to pay for at least a portion of the transaction.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
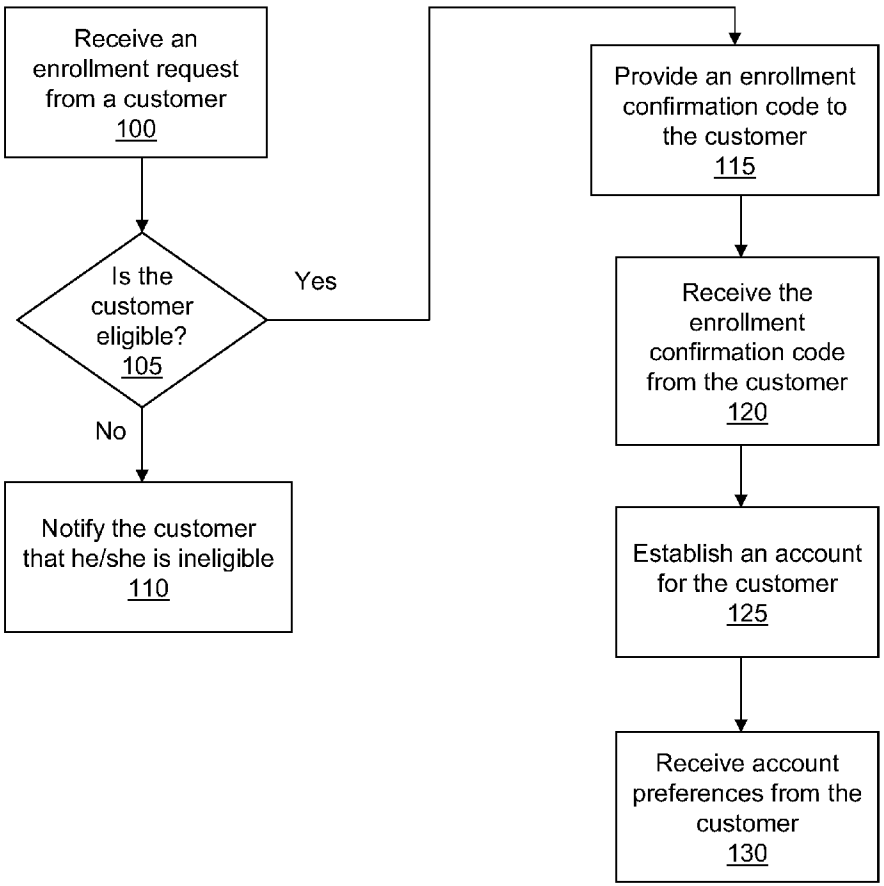
FIG. 1 is a flow diagram illustrating enrollment into a real-time loyalty rewards redemption program in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Described herein is a method, system, and computer-readable medium for providing real-time redemption of accumulated loyalty rewards. In an illustrative embodiment, the real-time redemption can occur at a point-of-sale such that a customer receives instant gratification when making a purchase. In another illustrative embodiment, the real-time redemption occurs without requiring merchants to have specialized point-of-sale devices such as credit card readers or cash registers. In one embodiment, a customer uses a financial card such as a credit card or debit card to make a purchase from a merchant. The financial card issuer receives an indication from the merchant that the customer is attempting to make a purchase with the financial card. In addition to determining whether the transaction should be approved or denied, the financial card issuer also determines whether the customer has accumulated loyalty rewards to cover all or a portion of the transaction. If the customer has such accumulated loyalty rewards and if the customer has enrolled into the program and requested alerts, the financial card issuer provides a real-time redemption alert to a mobile device of the customer. The real-time redemption alert requests instructions from the customer regarding whether he/she would like to use any of the accumulated loyalty rewards to cover all or a portion of the transaction. If the customer uses any accumulated loyalty rewards to pay for the transaction, the system automatically deducts the used loyalty rewards from the rewards balance of the customer and adjusts a billing statement of the customer to indicate that all or a portion of the transaction has been paid for using the loyalty rewards.

FIG. 1 is a flow diagram illustrating enrollment into a real-time loyalty rewards redemption program in accordance with an illustrative embodiment. In alternative embodiments, fewer, additional, and/or different operations may be performed. Also, the use of a flow diagram is not meant to be limiting with respect to the order of operations performed. An enrollment request to enroll in the real-time loyalty rewards redemption program is received from a customer in an operation 100. In an illustrative embodiment, the rewards request can be received electronically by a computing system that implements the real-time loyalty rewards redemption program. Alternatively, the enrollment request may be received over the telephone or in person by the entity that implements the real-time loyalty rewards redemption program. The real-time loyalty rewards redemption program can be implemented by a financial institution such as a bank or credit union, by a credit card company, by a dedicated customer loyalty program service provider, etc.

In an illustrative embodiment, the loyalty rewards are associated with a financial account such as a credit card account, a checking account associated with a debit card, a savings account associated with a debit card, an investment account, etc. The loyalty rewards can be accumulated by making purchases using the financial account, by maintaining a specified balance in the financial account, by making specified contributions to the financial account, and/or by any other action known to those of skill in the art.

In an operation 105, the system determines whether the customer is eligible for enrollment into the real-time loyalty rewards redemption program. The determination can be based on whether the customer is enrolled in or eligible for the customer loyalty program with which the real-time redemption program is associated. If the customer is not enrolled in the customer loyalty program, the customer may be prompted to establish a financial account that qualifies for the customer loyalty program. The determination can also be based on the account status of a financial account associated with the customer loyalty program. If there is a negative account status, the customer may be unable to enroll until the negative status is rectified. The determination can also be based on whether the customer has a wireless (or mobile) device that is capable of receiving real-time alerts. The determination can also be based on any other considerations or factors established by the entity that is offering the real-time redemption program.

If it is determined in operation 105 that the customer is not eligible for the real-time redemption program, the system notifies the customer that he/she is ineligible in an operation 110. The notification can be conveyed in the form of an e-mail, a text message, a notification in a dedicated application, a telephone call, and/or an in person discussion. If it is determined in operation 105 that the customer is eligible for the real-time redemption program, the system provides an enrollment confirmation code to the customer in an operation 115. In an illustrative embodiment, the enrollment confirmation code can be conveyed in an e-mail, a text message, or a notification in a dedicated application. The enrollment confirmation code can be in the form of a word, a number, an alphanumeric code, a link, etc. As discussed in more detail below, the enrollment confirmation code can be used by the customer to confirm enrollment. The enrollment confirmation code, which can be provided to a known e-mail address, account, phone number, etc. of the customer, can also be used by the entity offering the real-time redemption program to verify the authenticity of the enrollment request and help prevent fraudulent enrollment requests.

In an operation 120, the enrollment confirmation code is received from the customer. In one embodiment in which a word, number, or alphanumeric code is used as the enrollment confirmation code, the customer can be instructed to enter the enrollment confirmation code in an enrollment website of the entity that is providing the real-time redemption program. If the enrollment confirmation code is in the form of a link, the customer can be instructed to click on the link such that the customer is taken to an enrollment website of the entity that is providing the real-time redemption program.

In one embodiment, the enrollment can be conducted through a dedicated application that is downloaded onto an electronic device of the customer. The dedicated application can be downloaded directly from the entity providing the real-time redemption program, or from an application marketplace as known to those of skill in the art. The electronic device of the customer can be a cellular phone, a laptop computer, a tablet computer, a netbook computer, a desktop computer, a gaming device, etc. In an embodiment, where enrollment is conducted through a dedicated application, provision and/or receipt of the enrollment confirmation code may be conducted through the dedicated application.

In an operation 125, a real-time redemption account is established for the customer. In one embodiment, the real-time redemption account can be an add-on to an existing loyalty rewards account of the customer. Alternatively, the real-time redemption account may be a separate account. In an operation 130, account preferences are received from the customer. The account preferences can include a list of one or more merchants for which transactions result in a real-time redemption alert. Real-time redemption alerts are discussed in more detail with reference to FIG. 2. For example, the customer may indicate that he/she would like to receive a real-time redemption alert only for transactions made by the customer at a particular merchant. The account preferences can also include a list of one or more merchants for which transactions do not result in a real-time redemption alert. For example, the customer may indicate that he/she does not wish to receive a real-time redemption alert for transactions made at a particular merchant such as a fast food restaurant.

The account preferences can also include one or more times of the day, days of the week, etc. that the customer does or does not wish to receive real-time redemption alerts. As one example, the customer may indicate that he/she does not wish to receive real-time redemption alerts for transactions conducted during his/her lunch hour. The account preferences can also indicate types of goods/services for which a real-time redemption alert should or should not be received. As an example, the customer may specify that real-time redemption alerts should not be received if the transaction is payment for dry cleaning services. The account preferences can also include an indication of how real-time redemption alerts are to be received. For example, the real-time redemption alerts can be received via an e-mail, a text message, a notification in a dedicated application, etc. Real-time redemption alerts can also be received via a website such as an on-line banking website through which the customer is able to access his/her financial account. In such an embodiment, the real-time redemption alert can be provided to the customer via an e-mail or other notification within the website.

The account preferences can further include an indication of whether the customer wishes to receive real-time redemption alerts for transactions that cannot be fully covered by the accumulated loyalty rewards of the customer. As an example, the customer may wish to receive a real-time redemption alert for a $100 transaction even though the customer only has $60 in accumulated loyalty rewards. Alternatively, the customer may indicate that he/she only wishes to receive a real-time redemption alert if the transaction can be fully covered by the current balance of accumulated loyalty rewards. In one embodiment, the customer may specify a percentage of the transaction that has to covered by the rewards balance in order to receive a real-time redemption alert. For example, the customer may specify that he/she only wishes to receive such alerts if at least 50% of the transaction amount can be covered by the rewards balance. Alternatively, the percentage amount can be 10%, 25%, 40%, 75%, etc.

Figure 2:
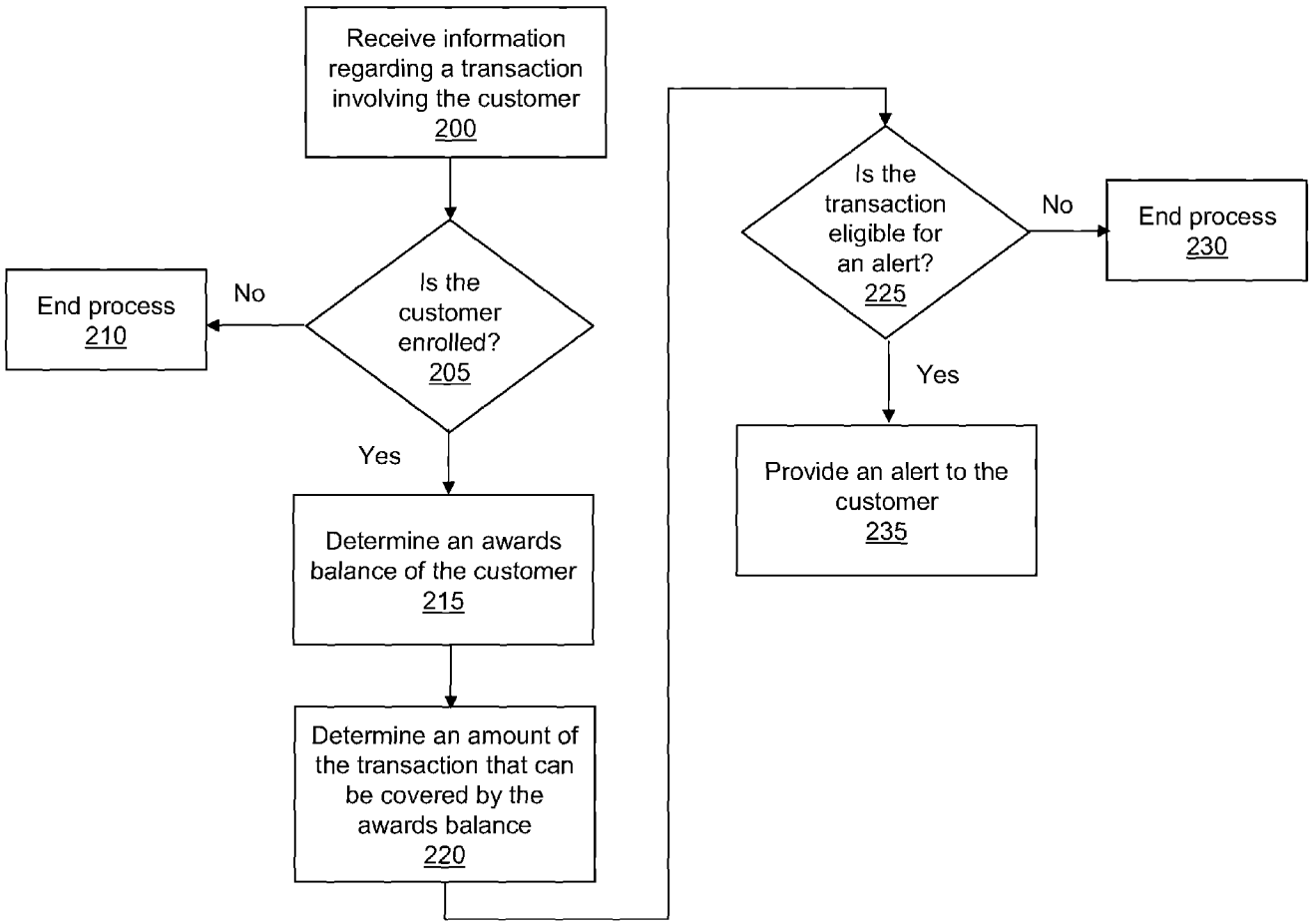
FIG. 2 is a flow diagram illustrating implementation of a transaction in accordance with an illustrative embodiment.

FIG. 2 is a flow diagram illustrating implementation of a transaction in accordance with an illustrative embodiment. In alternative embodiments, fewer, additional, and/or different operations may be performed. Also, the use of a flow diagram is not meant to be limiting with respect to the order of operations performed. In an operation 200, information regarding a transaction involving a customer enrolled in the real-time loyalty rewards redemption program is received. In an illustrative embodiment, the information regarding the transaction is received by a computing system as described in more detail with reference to FIG. 4. In another illustrative embodiment, the transaction is made using a financial card such as a credit card or a debit card that is associated with the customer loyalty program. The information regarding the transaction can include an identification of the merchant at which the transaction is made, an amount of the transaction, an identification of the customer and/or the financial account associated with the customer, a type of good or service involved in the transaction, etc.

In one embodiment, the customer uses his/her financial card at point-of-sale such as a department store, grocery store, restaurant, etc. When the financial card is swiped at the point-of-sale (either by the customer or by a store employee), information regarding the transaction is transmitted from the point-of-sale to the issuer of the financial card such that the issuer can approve/decline the transaction as known to those of skill in the art. If the issuer of the credit card that receives the information regarding the transaction is implementing the real-time redemption program, then the issuer can utilize the transaction information as discussed in more detail below. However, in one embodiment, a third party (e.g., a party other than the issuer of the financial card) may be implementing the loyalty rewards program and/or the real-time redemption program. In such an embodiment, the issuer of the financial card can provide the information regarding the transaction to the third party. The information regarding the transaction can be received from existing point-of-sale devices and without requiring merchants to have specialized point-of-sale devices.

In an operation 205, the system determines whether the customer or account associated with the transaction is enrolled in the real-time loyalty rewards redemption program. In an illustrative embodiment, the system utilizes the information regarding the transaction to make the determination. The system can determine whether the customer is enrolled by comparing identification information received in the transaction information to a database or other storage unit known to those of skill in the art. If the real-time redemption program is implemented by a third party, the third party can make the determination of whether the customer is enrolled. If the customer is not enrolled in the real-time loyalty rewards redemption program, the process ends in an operation 210.

If the customer is enrolled in the real-time loyalty rewards redemption program, the system determines an awards balance of the customer in an operation 215. The system can determine the awards balance by checking a database or other storage unit that is configured to store awards balances. If the real-time redemption program is implemented by a third party, the third party can determine the rewards balance. In one embodiment, the rewards balance may depend on the merchant and/or on the goods or services involved in the transaction. For example, the accumulated rewards may be worth more if the customer shops at a particular merchant. Similarly, the accumulated rewards may be worth more if the transaction involves specific goods or services such as gasoline purchases, if the transaction value exceeds a threshold amount, etc.

In an operation 220, the system determines an amount of the transaction that can be covered by the awards balance. The amount of the transaction that can be covered by the awards balance can be determined by comparing the transaction amount to the rewards balance. As discussed above, the awards balance may be specific to the transaction if the customer is given a rewards incentive to shop at a particular merchant or to purchase specific goods or services.

In an operation 225, the system determines whether the transaction is eligible for a real-time redemption alert. The determination can be based at least in part on the account preferences discussed with reference to FIG. 1. For example, the determination may be based on the time of day, the day, the merchant, the goods/services being purchased, etc. as discussed above with reference to FIG. 1. The determination of whether the transaction is eligible for a real-time redemption alert can also be based at least in part on the rewards balance and/or the portion of the transaction that can be covered by the rewards balance. For example, as discussed above, the customer may indicate that he/she only wishes to receive real-time redemption alerts if the transaction can be completely covered by the rewards balance, or only if a specified percentage of the transaction can be covered by the rewards balance.

If the system determines that the transaction is not eligible for a real-time redemption alert, the system ends the process in an operation 230. If the system determines that the transaction is eligible for a real-time redemption alert, the system provides a real-time redemption alert to the customer in an operation 235. As used herein, a 'real-time redemption alert' can refer to an alert which is transmitted to a customer essentially immediately upon processing the transaction and determining that the transaction is eligible for such an alert. As such, the customer can receive the real-time redemption alert and make a redemption decision while at the point-of-sale or shortly thereafter. However, as can be appreciated by one of skill in the art, it may take the system one or more milliseconds (ms), one or more seconds, one or more minutes, etc. to actually transmit the real-time redemption alert. Further, due to transmission delays, network failures, wireless device failures, etc., it may take one or more milliseconds (ms), one or more seconds, one or more minutes, etc. for the wireless device of the customer to receive or have access to the real-time redemption alert.

The real-time redemption alert can be provided in the form of an e-mail, a text message, an instant message, or a notification within a dedicated application. In an illustrative embodiment, the real-time redemption alert is provided to a wireless device of the customer such that the customer receives the real-time redemption alert in essentially real-time at the point-of-sale. The wireless device of the customer can be a cellular phone, a tablet computer, a portable gaming device, etc. In an alternative embodiment, the real-time redemption alert can be provided via a telephone call or any other method of communication known to those of skill in the art.

The real-time redemption alert can include a current rewards balance, an amount of the transaction, an identification of the merchant, an amount of the transaction that can be covered by the current rewards balance, and/or a remaining rewards balance if the customer decides to use rewards to cover a portion or all of the transaction amount. The real-time redemption alert can also include instructions regarding how the customer can pay for a portion or all of the transaction using accumulated rewards. For example, the customer may be able to provide instructions via an e-mail, via a text message, via an indication provided through a dedicated application, via an instant message, via dialing a phone number, etc.

Figure 3:
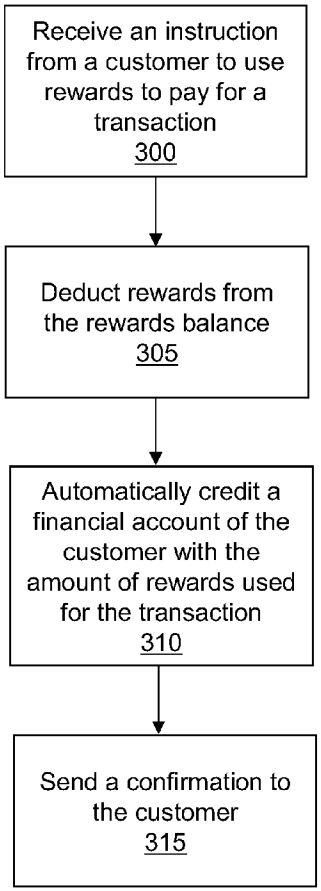
FIG. 3 is a flow diagram illustrating real-time rewards redemption in accordance with an illustrative embodiment.

FIG. 3 is a flow diagram illustrating real-time rewards redemption in accordance with an illustrative embodiment. In alternative embodiments, fewer, additional, and/or different operations may be performed. Also, the use of a flow diagram is not meant to be limiting with respect to the order of operations performed. In an operation 300, the system receives an instruction from a customer to use at least a portion of his/her rewards balance to pay for a transaction. In an illustrative embodiment, the instruction can be received in response to a real-time redemption alert as discussed with reference to FIG. 2. The instruction can be submitted through an e-mail, a text message, a telephone call, a dedicated application, etc. In one embodiment, the customer may log in to his/her loyalty rewards account through a website and provide the instruction via the website.

In an illustrative embodiment, the instruction to use rewards can be a simple indication from the customer to use all or a portion of the rewards balance to pay for the transaction. If the customer wishes to only pay for a portion of the transaction with rewards, the instruction may also indicate an amount of the rewards balance to use for the transaction. As an example, the transaction may be for $120 and the customer may indicate that he/she wishes to pay for only $50 of the transaction using his/her rewards.

In an operation 305, the system deducts an appropriate amount of rewards from the rewards balance of the customer. The amount of rewards deducted from the rewards balance is determined based on the instruction received from the customer in operation 300. The rewards can be deducted from the rewards balance using any method known to those of skill in the art. In an operation 310, the system automatically credits a financial account of the customer with the amount of rewards used for the transaction. In an illustrative embodiment, the financial account which is credited is the same financial account that was used during the transaction (e.g., a credit card account of a credit card used for the transaction, a checking or savings account tied to a debit card used for the transaction, etc.). In an alternative embodiment, the financial account credited by the system may be selected by the customer as an account preference, and may be different than the financial account used to make the transaction. The financial account can be credited using any method known to those of skill in the art.

In an operation 315, a confirmation is sent to the customer. The confirmation can be sent via e-mail, text message, instant message, a notification through a dedicated application, etc. The confirmation can include an indication that rewards were used to pay for at least a portion of the transaction. The confirmation can also indicate the amount of rewards that were used, the remaining rewards balance, etc. As such, the system described herein allows customers to use their rewards for transactions in real-time via real-time redemption alerts that do not involve specialized equipment at the point-of-sale.

Figure 4:
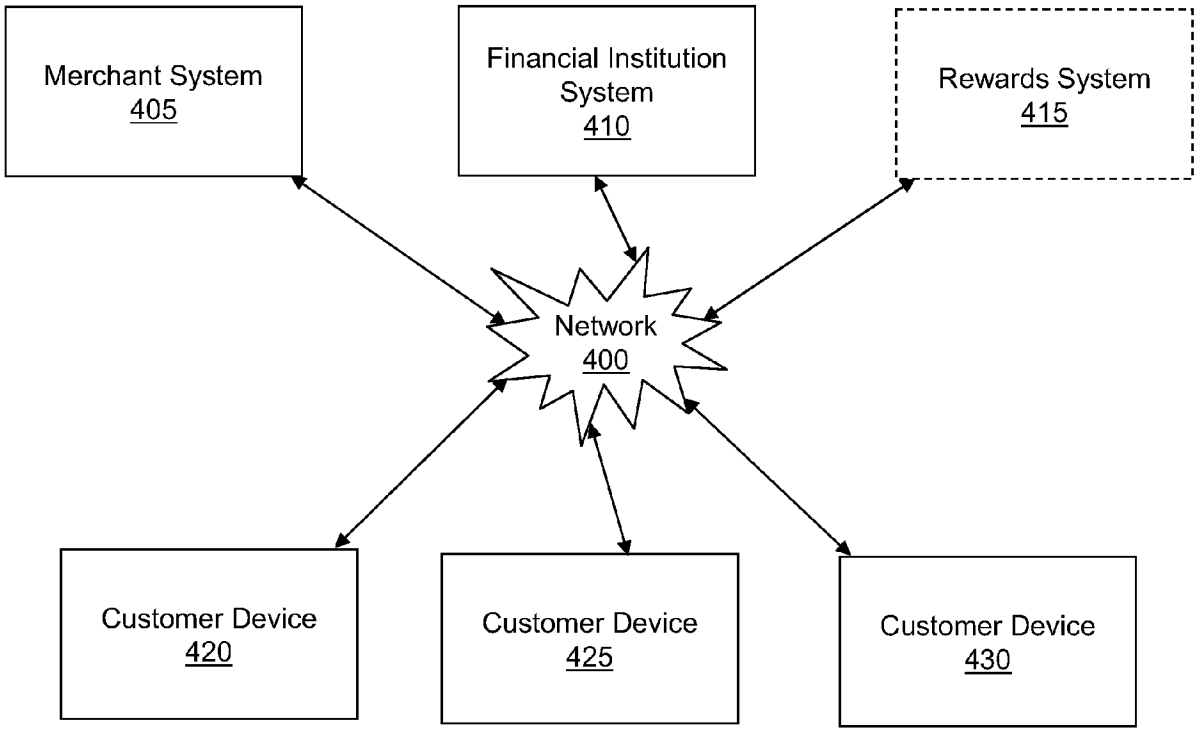
FIG. 4 is a block diagram illustrating a system for implementing the real-time customer loyalty program in accordance with an illustrative embodiment.

FIG. 4 is a block diagram illustrating a system for implementing the real-time customer loyalty program in accordance with an illustrative embodiment. In alternative embodiments, fewer, additional, and/or different components may be included in the system. The system includes a merchant system 405, a financial system 410, a user device 420, a user device 425, and a user device 430. Depending the on the embodiment, the system may also include a rewards system 415. Each of the components of FIG. 4 can communicate with one another via network 400. Network 400 can be the Internet, a cellular network, a satellite network, and/or any other communications network known to those of skill in the art.

Merchant system 405 can include a point-of-sale device such as a card reader and/or a cash register located at a merchant location such as a grocery store, department store, restaurant, etc. The component(s) of merchant system 405 can include a processor, memory, transceiver, user interface, etc. as known to those of skill in the art. Merchant system 405 can be utilized to conduct transactions involving the purchase of goods/services by a customer. In an illustrative embodiment, the customer can use a financial card such as a credit card or a debit card for the transaction. The merchant or the customer can swipe the credit card through a card reader of merchant system 405, and merchant system 405 can transmit information regarding the transaction to financial institution system 410 via network 400.

Financial institution system 410 can be a computing system operated by the financial institution that issued the financial card used for the transaction. Financial institution system 410 can include a processor, memory, transceiver (e.g., a receiver and/or a transmitter), user interface, etc. as known to those of skill in the art. In an illustrative embodiment, financial institution system 410 can receive the information regarding the transaction from merchant system 405 via network 400. Financial institution system 410 can process the transaction information to approve or deny the transaction as known to those of skill in the art. In one embodiment in which the rewards program and real-time rewards redemption program are implemented by the financial institution, financial institution system 410 can also process the transaction information to determine whether a real-time redemption alert should be sent as discussed above with reference to FIG. 2. In such an embodiment, rewards system 415 may not be present.

In an alternative embodiment in which the rewards program and real-time rewards redemption program are operated by a third party in control of rewards system 415, financial institution system 410 can provide the transaction information to rewards system 415 through network 400. In such an embodiment, rewards system 415 can process the transaction information to determine whether a real-time redemption alert should be sent as discussed above with reference to FIG. 2. Rewards system 415 can include a processor, memory, transceiver, user interface, etc. as known to those of skill in the art.

In an illustrative embodiment, customer devices 420, 425, and 430 can be wireless communication devices such as cellular phones, tablet computers, portable gaming devices, netbooks, etc. Each of customer devices 420, 425, and 430 can include a processor, memory, transceiver, user interface, etc. as known to those of skill in the art. In an illustrative embodiment, a customer can use his/her customer device to enroll into the real-time rewards redemption program, set customer preferences for the real-time rewards redemption program, and receive real-time redemption alerts from financial institution system 410 or rewards system 415 depending on the embodiment. The real-time redemption alerts can be received via network 400. The customer can also use his/her customer device to transmit redemption instructions and/or receive confirmations through network 400.

Any of the components or systems described with reference to FIG. 4 can include computer-readable instructions stored in a computer-readable medium such as a computer memory. The computer-readable instructions can, if executed by a processor, be configured to perform any of the operations described herein.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A method comprising:

receiving, at a computing system, information regarding a transaction associated with a financial account of a customer;

determining, based at least in part on the information regarding the transaction, whether to provide a redemption alert to the customer;

if it is determined that the redemption alert is to be provided, providing the redemption alert to a mobile device of the customer;

receiving a response to the redemption alert from the mobile device of the customer, wherein the response indicates that at least a portion of accumulated loyalty rewards of the customer are to be used to pay for at least a portion of the transaction;

deducting at least the portion of the accumulated loyalty rewards from a rewards balance of the customer; and crediting the financial account of the customer with a value of at least the portion of the accumulated loyalty rewards.

2. The method of claim 1, wherein the information regarding the transaction is received from a point-of-sale device such that the computing system is able to decline or approve the transaction.

3. The method of claim 1, wherein the response to the redemption alert indicates an amount of the transaction that is to be paid for with the accumulated loyalty rewards.

4. The method of claim 1, wherein determining whether to provide the redemption alert is based at least in part on a rewards balance of the customer.

5. The method of claim 1, wherein determining whether to provide the redemption alert is based at least in part on a preference of the customer.

6. The method of claim 5, wherein the preference comprises a request from the customer to not receive the redemption alert if the transaction is with a specified merchant.

7. The method of claim 5, wherein the preference comprises a request from the customer to not receive the redemption alert if the transaction is for a specified good or service.

8. The method of claim 5, wherein the preference comprises a request from the customer to not receive the redemption alert if the transaction occurs during a specified time period.

9. A system comprising:

a receiver configured to receive information regarding a transaction associated with a financial account of a customer;

a processor operatively coupled to the receiver and configured to determine, based at least in part on the information regarding the transaction, whether to provide a redemption alert to the customer; and a transmitter operatively coupled to the processor and configured to provide the redemption alert to a mobile device of the customer if it is determined that the redemption alert is to be provided;

wherein the receiver is further configured to receive a response to the redemption alert from the mobile device of the customer, and wherein the response indicates that at least a portion of accumulated loyalty rewards of the customer are to be used to pay for at least a portion of the transaction;

wherein the processor is further configured to:

deduct at least the portion of the accumulated loyalty rewards from a rewards balance of the customer; and credit the financial account of the customer with a value of at least the portion of the accumulated loyalty rewards.

10. The system of claim 9, wherein the information regarding the transaction is received from a point-of-sale device such that the system is able to decline or approve the transaction.

11. The system of claim 9, wherein the response to the redemption alert indicates an amount of the transaction that is to be paid for with the accumulated loyalty rewards.

12. The system of claim 9, wherein the processor determines whether to provide the redemption alert based at least in part on the rewards balance of the customer.

13. The system of claim 9, wherein the processor determines whether to provide the redemption alert based at least in part on a preference of the customer.

14. The system of claim 13, wherein the preference comprises a request from the customer to not receive the redemption alert if the transaction is with a specified merchant.

15. The system of claim 13, wherein the preference comprises a request from the customer to not receive the redemption alert if the transaction is for a specified good or service.

16. A non-transitory computer-readable medium having computer-executable instructions stored thereon, wherein the computer-executable instructions when executed cause a computer to:

process received information regarding a transaction associated with a financial account of a customer;

determine, based at least in part on the information regarding the transaction, whether to provide a redemption alert to the customer;

provide the redemption alert to a mobile device of the customer if it is determined that the redemption alert is to be provided;

process a received response to the redemption alert from the mobile device of the customer, wherein the response indicates that at least a portion of accumulated loyalty rewards of the customer are to be used to pay for at least a portion of the transaction;

deduct at least the portion of the accumulated loyalty rewards from a rewards balance of the customer; and credit the financial account of the customer with a value of at least the portion of the accumulated loyalty rewards.

17. The computer-executable instructions of claim 16, wherein the response to the redemption alert indicates an amount of the transaction that is to be paid for with the accumulated loyalty rewards.

18. The computer-executable instructions of claim 16, wherein determining whether to provide the redemption alert is based at least in part on the rewards balance of the customer.

19. The computer-executable instructions of claim 16, wherein determining whether to provide the redemption alert is based at least in part on a preference of the customer, and wherein the preference comprises a request from the customer to not receive the redemption alert if the transaction is with a specified merchant.

20. The computer-executable instructions of claim 16, wherein determining whether to provide the redemption alert is based at least in part on a preference of the customer, and wherein the preference comprises a request from the customer to not receive the redemption alert if the transaction occurs during a specified time period.

* * * * *

UNITED STATES PATENT AND TRADEMARK OFFICE

CERTIFICATE OF CORRECTION

PATENT NO. : 8,332,290 B1
APPLICATION NO. : 13/344252
DATED : December 11, 2012
INVENTOR(S) : Dominic Victor Venturo and Robert H. Daly It is certified that error appears in the above-identified patent and that said Letters Patent is hereby corrected as shown below:

IN THE CLAIMS

Claim 4, Column 9, Line 53:

The word "a" should be changed to --the--.

Signed and Sealed this
Nineteenth Day of March, 2013

Teresa Stanek Rea
*Acting Director of the United States Patent and Trademark Office*